United States Patent [19]

Casad

[11] Patent Number: 4,863,407

[45] Date of Patent: Sep. 5, 1989

[54] WATER SKI TOW HANDLE ASSEMBLY

[75] Inventor: Thomas R. Casad, Celina, Ohio

[73] Assignee: Casad Manufacturing Corp., St. Marys, Ohio

[21] Appl. No.: 215,377

[22] Filed: Jul. 5, 1988

[51] Int. Cl.[4] ..... A63C 15/06

[52] U.S. Cl. ..... 441/69

[58] Field of Search ..... 441/69; 16/110 R, 111 R; 272/61, 143; 114/253, 254

[56] References Cited

U.S. PATENT DOCUMENTS

| | | | |
|---|---|---|---|
| D. 248,587 | 7/1978 | Rumbaugh | D34/41 |
| D. 256,487 | 8/1980 | Pittman | D21/230 |
| D. 258,228 | 2/1981 | Rumbaugh | D21/230 |
| 3,092,068 | 6/1963 | Brownson | 441/69 |
| 3,304,902 | 2/1967 | Byrne et al. | 441/69 |
| 3,537,418 | 11/1970 | Brownson | 441/69 |
| 4,043,290 | 8/1977 | Holland | 441/69 |
| 4,060,049 | 11/1977 | Rumbaugh | 441/69 |
| 4,182,258 | 1/1980 | Presser | 441/69 |
| 4,263,685 | 4/1981 | Neuscheler | 441/69 |
| 4,335,478 | 6/1982 | Pittman | 441/69 |
| 4,540,371 | 9/1985 | Taylor | 441/69 |
| 4,585,420 | 4/1986 | Taylor | 441/69 |
| 4,740,181 | 4/1988 | Kell | 441/69 |

FOREIGN PATENT DOCUMENTS

| | | | |
|---|---|---|---|
| 1227230 | 4/1971 | United Kingdom | 441/69 |

*Primary Examiner*—Sherman D. Basinger
*Assistant Examiner*—Stephen P. Avila
*Attorney, Agent, or Firm*—Emch, Schaffer, Schaub & Porcello Co.

[57] ABSTRACT

A water ski tow handle assembly comprising a handle and a pair of end caps is disclosed. The handle defines first and second handle rope passageways extending transversely through each end of the handle at an angle to each other. The first handle rope passageway is in a spaced apart relationship to the second handle rope passageway and the end of the handle. The second handle rope passageway is in a spaced apart relationship to the first handle rope passageway and adjacent the end of the handle. The end caps matingly receiving an end of the handle. Each end cap has a finger protector sleeve and a cap portion. The cap portion includes a collar and a plug which define a recess for matingly receiving the end of the handle. The finger protector sleeve and the cap portion define a first end cap rope passageway extending longitudinally through the finger protector sleeve and the cap portion. The end cap defines a second end cap rope passageway extending transversely through the cap portion. The second end cap rope passageway is in a spaced apart relationship to the first end cap rope passageway. The end cap defines a third end cap rope passageway extending at an acute angle between the first end cap rope passageway and the second end cap rope passageway. The third end cap rope passageway connects the first end cap rope passageway to the second end cap rope passageway. Each end cap is positioned on the handle such that the first handle rope passageway and the first end cap rope passageway are in coaxial alignment and the second handle rope passageway and the second end cap rope passageway are in coaxial alignment.

17 Claims, 3 Drawing Sheets

WATER SKI TOW HANDLE ASSEMBLY

BACKGROUND OF THE INVENTION

The present invention relates to a water ski tow handle assembly.

There are may different ski tow rope handle assemblies currently in use by water skiers. Representative of such water ski handles include U.S. Pat. Nos. 4,585,420, Taylor; 4,540,371, Taylor; 4,335,478, Pittman; Des. 258,228, Rumbaugh; Des. 256,487, Pittman; 4,182,258, Presser; Des. 248,587, Rumbaugh; 4,060,049, Rumbaugh; 4,043,290, Holland; 3,537,418, Brownson; and, 3,092,068, Brownson.

These prior art ski tow handles, while suitable for use by water skiers, have several drawbacks. One drawback is that the water skier's safety can be compromised due to the inherent design of the prior art ski handles. Various prior art ski handle require that the water skier grasp the handle at a point immediately adjacent the exposed tow rope. The water skier may suffer rope burns or abrasions or even have his fingers entwined in the tow rope. Still other ski handles do not adequately prevent the two rope from inadvertantly slipping off the end of the handle, thereby leaving the water skier at risk when the handle separates from the two line. Still other ski handles leave much of the tow rope exposed to harsh conditions such as abrasion, fraying or damage due to repeated exposure to water, sunshine, oil or gasoline. These harsh conditions decrease the useful life of the tow rope.

Other drawbacks of the prior art ski handles relate to both the convenience to the manufacturer in producing and assembling the water ski handle assembly and the convenience to the water skier in using the water ski handle assembly. The various prior art ski handles require that the tow rope be circuitously bent or threaded through the handle during the assembly process thereby adding to the amount of time and labor required for manufacturing the handle assembly. Other various prior art ski handles are inconvenient to use since the hollow handles become filled with water during use and thus do not readily float on the surface of the water. In order to increase the floatability of the handles various manufacturers fill the handle with a buoyant material, which adds both time and cost to the manufacturing and assembly of the handles. Still others plug the handles with metal plugs which adds undesirable weight to the handle and which decreases the floatability of the handle. Also, the insertion of the metal plugs into the handle increases the manufacturing and assembly time required to produce the water ski handle assembly.

Thus, there is a need for a water ski tow handle assembly without the above-mentioned drawbacks which handle assembly offers both safety and convenience to the water skier and offers ease of production and assembly to the handle manufacturer. The water ski two handle assembly of the present invention is directed to these needs, as will be readily understood by referring to the specification, drawings and claims disclosed herein.

SUMMARY OF THE INVENTION

The present invention provides a water ski two handle assembly including a handle and end caps on each end of the handle. Each end of the handle has a first pair of holes defining a first rope passageway and a second pair of holes defining a second rope passageway. The first pair of holes are in a spaced apart relationship to the end of the handle. The second pair of holes are in a spaced apart relationship to the first pair of holes, and are adjacent the end of the handle. The first and second rope passageways extend transversely through the handle at a substantially right angle to each other.

Each end cap matingly receives an end of the handle. Each end cap includes a finger protector sleeve and a cap portion. The finger protector sleeve and the cap portion define a first rope passageway extending along the longitudinal axis of the finger protector sleeve. The cap portion includes a collar and a plug which define a recess within the cap portion for receiving the end of the handle. The cap portion defines a second rope passageway extending transversely through the cap portion. The cap portion also defines a third rope passageway extending at an acute angle between the first rope passageway in the end cap and the second rope passageway in the end cap. The third rope passageway connects the first rope passageway to the second rope passageway.

In order to assemble the water ski handle assembly of the present invention, the end caps are positioned on each end of the handle. The first pair of holes in the handles are aligned with the first rope passageway in the end cap and the second pair of holes in the handle are aligned with the second rope passageway in the end cap.

A portion of a rope is first passed through the first rope passageway in the end cap and through the first pair of holes in the handle. The rope emerges from the opposing end of the first rope passageway at the mid point of the third rope passageway in the cap portion. The rope extends at an acute angle along one-half of the third rope passageway in the cap portion. The rope passes into the cap portion through the second rope passageway and through the second pair of holes in the handle. The rope emerges from the second rope passageway and extends at an acute angle along the other half of the third rope passageway in the cap portion. One end of the rope is then threaded or braided into itself to form a closed loop and a braided portion. A distal portion of the rope extending from the first rope passageway is pulled taut such that the closed loop of the rope is snugly held within the third rope passageway in the cap portion. The braided portion of the rope is thus positioned within the first rope passageway in the end cap. A corresponding portion of the rope is likewise threaded through the end cap on the opposing end of the ski tow handle assembly. The ends of the rope meet at a predetermined distance away from the handle assembly and are joined together by passing one end of the rope into the opposing rope or by knitting threads of the rope.

It is an object of the present invention to provide a water ski tow handle assembly which provides both safety and convenience to the water skier.

More specifically, it is an object of the present invention to provide a handle assembly which provides additional protection to the skiers' hands by having the tow rope in a spaced apart relationship to the portion of the handle assembly which is grasped by the water skier.

It is a further object of the present invention to provide a handle assembly which provides additional safety to the skier by lessening the likelihood of having the tow rope become detached or slip off the end of the handle assembly.

It is still a further object of the present invention to provide a handle assembly which protects the tow rope from stresses due to bending or from abrasion, fraying or damage from harsh conditions.

It is still a further object of the present invention to provide a handle assembly which readily floats in the water thereby making retrieval of the handle assembly easier for the water skier.

It is still a further object of the present invention to provide a handle assembly which is relatively simple to manufacture and assemble.

These and other objects and advantages of the present invention will be readily understood by reference to the specification, drawing and claims disclosed herein.

DESCRIPTION OF THE INVENTION

Figure 1:
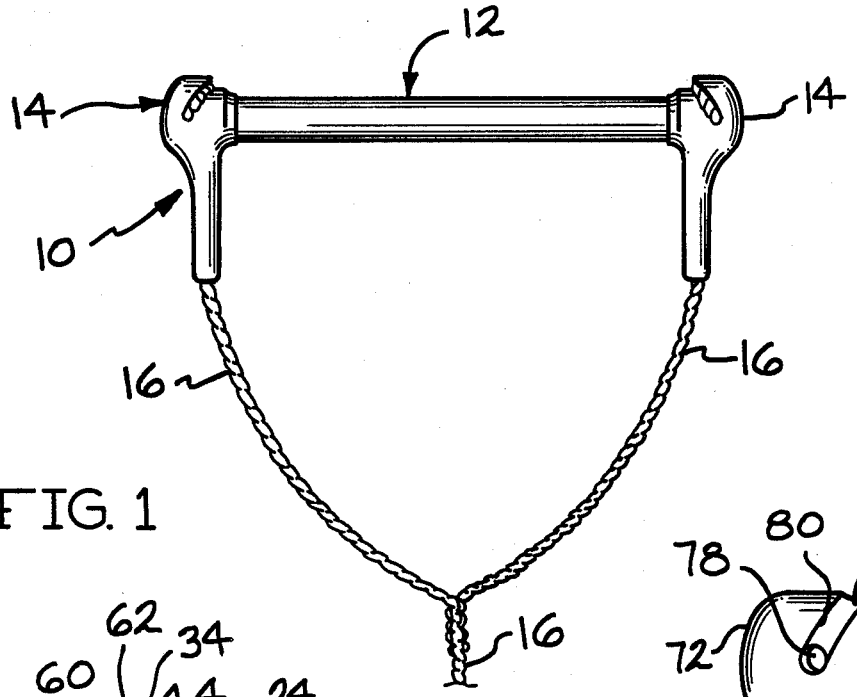
FIG. 1 is a plan view of a water ski tow handle assembly.
Figure 2:
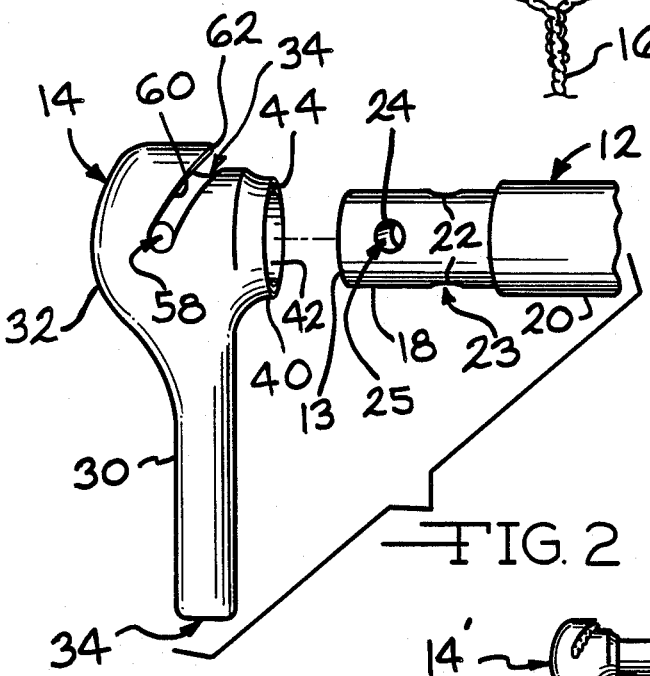
FIG. 2 is a fragmentary perspective view of an unassembled water ski tow handle assembly.

Referring now to FIGS. 1 and 2, a water ski tow handle assembly 10 according to the present invention is shown. The water ski tow handle assembly 10 generally includes a handle 12 having ends 13 and end caps 14 mounted on each end 13 of the handle 12. A rope generally indicated by the numeral 16 is secured in the tow handle assembly 10 in a manner which will be explained in detail below. The rope 16 has a free end (not shown) for attachment to a boat (not shown). For many uses of the present invention the rope 16 can be a hollow or solid, braided or twisted, polypropylene or nylon rope; however, it is contemplated that any type of rope can be used with the present invention.

Referring now in particular to FIG. 2, one-half of the water ski tow handle assembly 10 is shown. It is to be understood that the handle assembly 10 generally includes the longitudinally extending handle 12 having end caps 14 on each end 13 of the handle 12. However, for the sake of clarity, only one half of the handle assembly will be shown and discussed in detail. The handle 12 generally comprises an elongated core bar 18 which, in a preferred embodiment, is a hollow cylindrical tube. A molded grip or covering 20 is formed about and encloses the core bar 18. In a preferred embodiment the core bar 18 is made of a lightweight metal material such as aluminum and the grip 20 is preferably made of a resilient material having a textured surface to insure a good non-slip grip, such as a cork/rubber mixture or a neoprene material. The handle 12 includes a first pair of holes 22 extending transversely therethrough and defining a first rope passageway 23. The first pair of holes 22 are in a spaced apart relationship to the end 13 of the handle 12. The handle 12 further includes a second pair of holes 24 also extending transversely therethrough and defining a second rope passageway 25. The second pair of holes 24 are in a spaced apart relationship to the first pair of holes 22 and are adjacent the end 13 of the handle 12. In a preferred embodiment, the first rope passageway 23 and the second rope passageway 25 extend transversely through the handle 12 generally at an angle perpendicular to each other.

Figure 4:
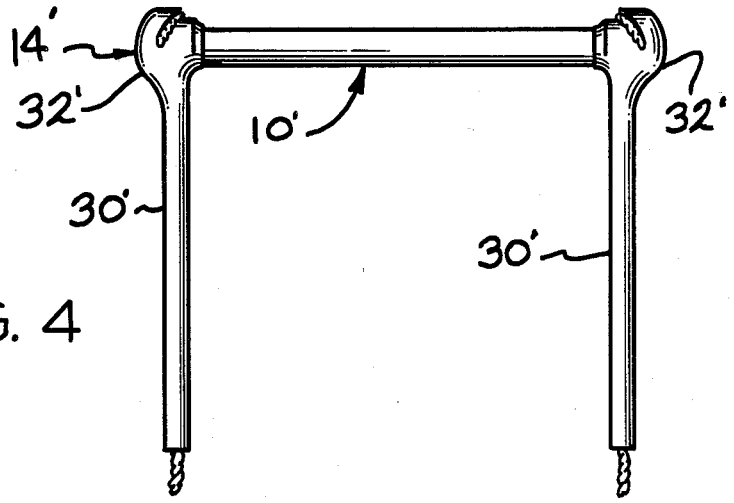
FIG. 4 is a plan view of an alternative embodiment of a water ski tow handle assembly.

As seen in FIGS. 1 and 4, the end cap 14 is positioned on the end 13 of the handle 12. The end cap 14 is generally made of a material which acts to increase the floatability of the ski tow handle assembly 10. In a preferred embodiment the end cap 14 is made of a material somewhat softer than the grip cover 20 in order to provide cushioning for the skiers' hands at the ends of the ski tow handle assembly 10. The end cap 14, when positioned on the end 13 of the handle 12, effectively eliminates a great deal of water from entering the core bar 18 by trapping air inside the handle 12, thereby increasing the floatability of the ski tow handle assembly 10.

The end cap 14 generally includes a finger protector sleeve 30 and a cap portion 32. In a preferred embodiment, the finger protector sleeve 30 and the cap portion 32 are molded as an integral unit to form the end cap 14. The end cap 14 is preferably made of a resilient material such that the end cap 13 of the handle 12 is securely held within the cap portion 32. By referring to FIGS. 5 and 6, it can be seen that the protector sleeve 30 extends in a direction away from the cap portion 32. In a preferred embodiment, the finger protector sleeve 30 extends in a direction generally perpendicular to the longitudinal axis of the handle 12. The finger protector sleeve 30 and cap portion 32 define a first rope passageway 34 extending axially through the finger protector sleeve 30, through the cap portion 32, and terminates at the exterior of the cap portion 32. The first rope passageway 34 receives a portion of the tow rope 16, as will be explained in detail below.

It is contemplated that the finger protector sleeve 30 can vary in length, depending on the needs of the water skier. The finger protector sleeve 30, as seen in the embodiment in FIG. 1, generally extends a short distance from the cap portion 32. However, as shown in the embodiment in FIG. 4, the ski tow handle assembly 10' can include an end cap 14' having a longer finger protector sleeve 30' which extends from a cap portion 32'.

The cap portion 32 of the end cap 14 is shown in greater detail in FIGS. 5–8. The cap portion 32 generally includes a collar 40 and a plug 42. The collar 40 and plug 42 define a recess 44 for matingly receiving the end 13 of the handle 12. In a preferred embodiment, the recess 44 and the plug 42 snugly receive the end 13 of the handle 12, as can readily be seen by referring to FIG. 10 such that the end cap 14 is securely held in position on the end 13 of the handle 12. In the embodiment shown, the recess 44 has a substantially cylindrical shape. However, it is within the contemplated scope of the present invention that the sides of the recess can extend at a slight angle of, for example, 3 degrees, to further enhance the mating engagement of the handle in the end cap (not shown). Referring again to FIGS. 5–8, the plug 42 extends axially within the collar 40 of the cap portion 32 in a direction toward the handle 12. It is also within the contemplated scope of the present invention the plug 42 have either a substantially cylindrical shape or a slight tapered or frustoconical shape (not shown) such that the plug 42 is matingly received within the end 13 of the handle 12 thus forming a substantially tight seal within the handle 12.

Figure 5:
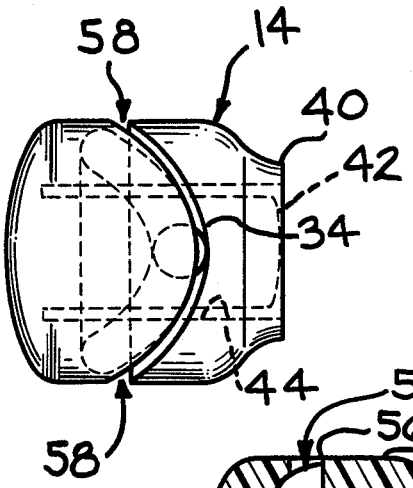
FIG. 5 is a top view, partially in phantom, of an end cap of the water ski tow handle assembly.
Figure 7:
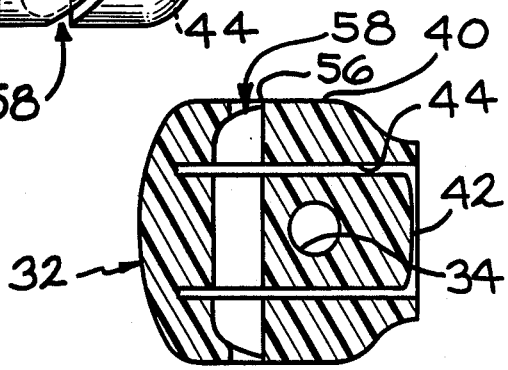
FIG. 7 is a view taken along line 7—7 in FIG. 6.
Figure 6:
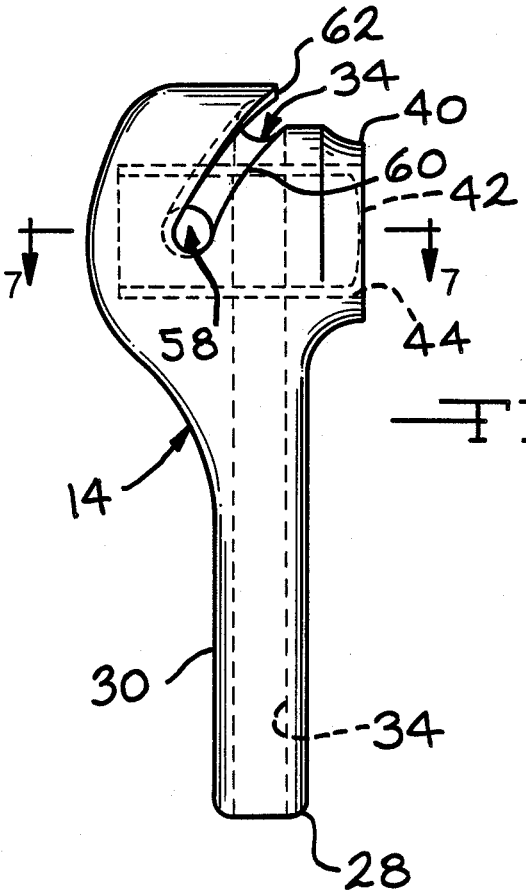
FIG. 6 is a plan view, partially in phantom, of the end cap of the water ski tow handle assembly.
Figure 8:
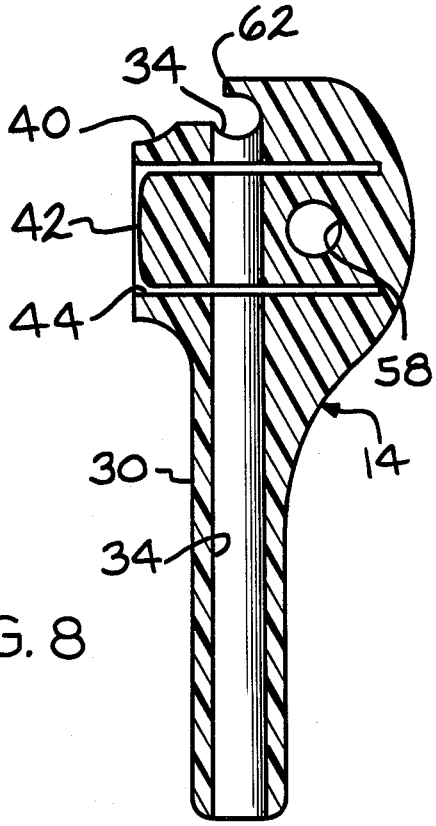
FIG. 8 is a cross-sectional view of the end cap of the water ski tow handle assembly.

Referring now in particular to FIGS. 5 and 7, it can be seen that the cap portion 32 defines a second rope passageway 58 extending transversely through the cap portion 32 of the end cap 14. The second rope passageway 58 in the end cap 14 is in a spaced apart relationship to the first rope passageway 34 in the end cap 14. In a preferred embodiment, the second rope passageway 58 extends through the end cap 14 generally at a perpendicular angle to the first rope passageway 34. The second rope passageway 58 receives a portion of the tow rope 16, as will be explained in detail below.

The end cap 14 further defines a third rope passageway 60 in the end cap. In a preferred embodiment, the third rope passageway generally extends along the exterior of the cap portion 32 of the end cap 14, as can best be seen in FIGS. 2 and 6. The third rope passageway 60 extends from the transversely extending second rope passageway 58 to the axially extending first rope passageway 34 at a generally acute angle. As can readily be seen by referring to FIG. 5, the third rope passageway 60 is in a spaced apart relationship to the finger protector sleeve 30 such that there is s decreased likelihood that the skier's hands will come into contact with the rope 16 when the rope 16 is positioned within the third rope passageway 60. The third rope passageway 60 is also in a spaced apart relationship to the first rope passageway 34. A mid point of the third rope passageway 60 terminates immediately adjacent the first rope passageway 34, as can readily be seen by referring to FIGS. 5–7. The third rope passageway 60 is in a spaced apart relationship to the handle 12 to further insure protection of the skiers' hands from inadvertantly coming into contact with the rope 16 in the third rope passageway 60. The third rope passageway 60 effectively holds the rope 16 in position in the end cap 14 and prevents the rope 16 from slipping off the end cap 14.

Figure 3:
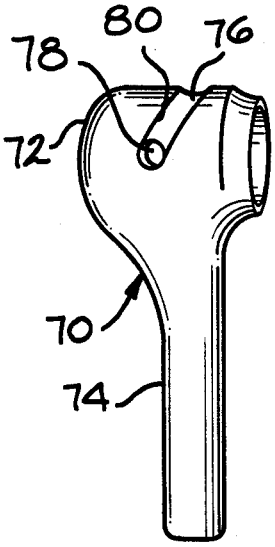
FIG. 3 is a perspective view of an alternative embodiment of an end cap of the present invention.

In a preferred embodiment the cap portion 32 further includes a protective lip or flange 62 which at least partially extends over the third rope passageway 60. The flange 62 shields the rope 16 from abrasion and provides further protection to the water skiers' hands. However, it is also within the contemplated scope of the present invention that the end cap 14 be formed without a protective flange as can be seen by referring to FIG. 3, which shows an alternative embodiment of an end cap 70 having a cap portion 72 and a finger protector sleeve 74. The end cap 70 defines a first rope passageway 76 extending axially through the finger protector sleeve 74 and the cap portion 72. The cap portion 72 further defines the second rope passageway 78 extending transversely through the cap portion 72 and which is in spaced apart relationship to the first rope passageway 74. The end cap 70 further defines a third rope passageway 80 which generally extends along the exterior of the cap portion 72 of the end cap 70. It is also within the contemplated scope of the present invention, that the third rope passageway be formed within the cap portion such that the rope is completely protected by the cap portion of the end cap (not shown).

Figure 9:
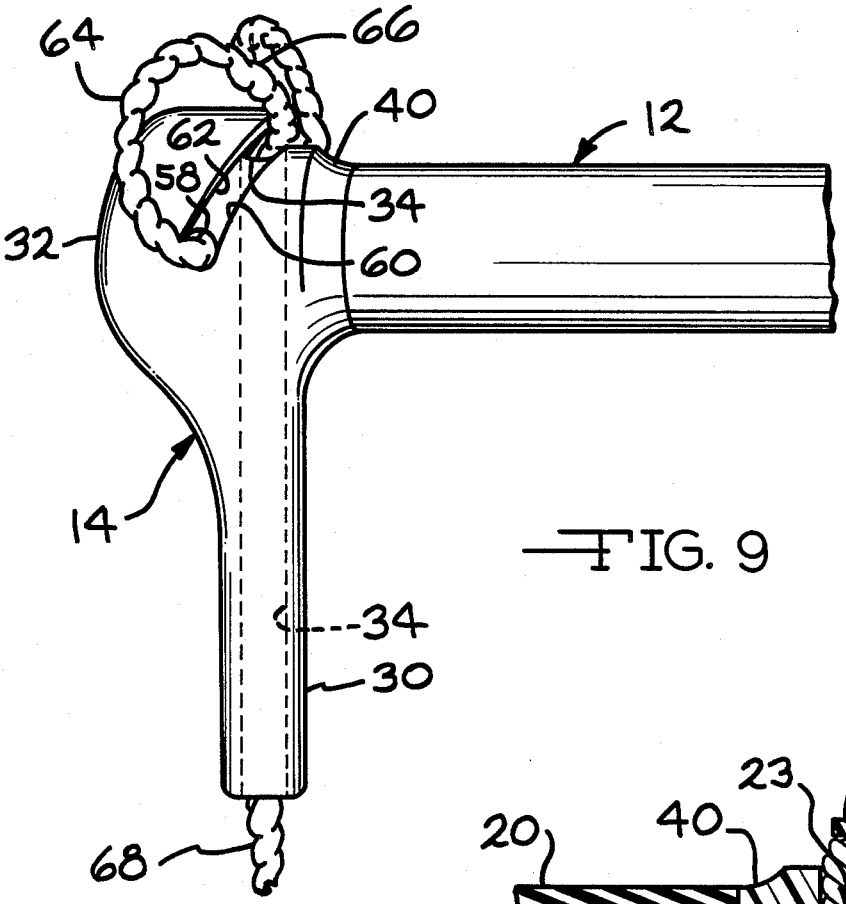
FIG. 9 is a fragmentary plan view, partially in phantom, showing a rope partially positioned in the water ski tow handle assembly.
Figure 10:
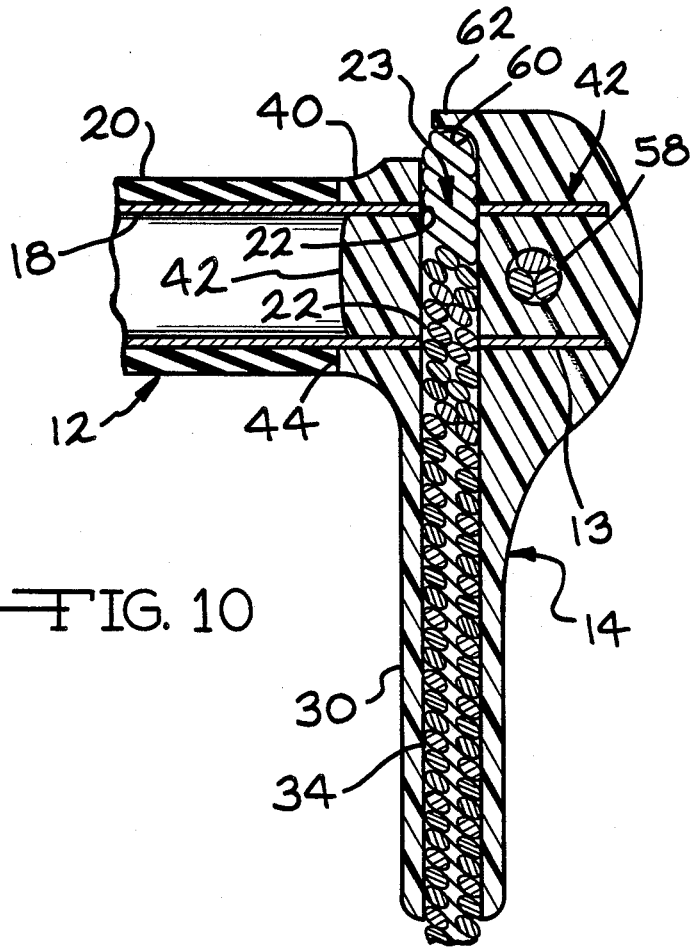
FIG. 10 is a fragmentary, cross-sectional view, showing the rope positioned in the water ski tow handle assembly.

Referring now in particular to FIGS. 2, 9 and 10, the handle 12 is shown to be matingly positioned within the end cap 14. In a preferred embodiment, the grip 20 terminates at a point spaced apart a short distance from the end 13 of the core bar 18 such that the end 13 is bare or uncovered by the grip 20. However, it is also within the contemplated scope of the present invention that the grip extend along substantially the length of the core bar and terminate at a point adjacent the end of the handle (not shown).

The handle 12 is axially positioned within the collar 40 of the end cap 14 such that the plug 42 extends axially inward into the handle 12. The end 13 of the core bar 18 is matingly engaged within the recess 44 of the cap portion 32.

As can be seen in FIG. 10, the first pair of holes 22 in the handle 12 are in coaxial alignment with the first rope passageway 34 extending through the finger protector sleeve 30 and the cap portion 32 of the end cap 14. The second pair of holes 24 in the handle 12 are in coaxial alignment with the second rope passageway 58 extending transversely through the cap portion 32 of the end cap 14.

During assembly of the water ski tow handle assembly 10 of the present invention, a portion of the rope 16 is first passed through the first rope passageway 34 in the finger protector sleeve 30 and the cap portion 32 of the end cap 14. The rope 16 also passes through the first rope passageway 23 in the handle 12 defined by the first pair of holes 22. The rope 16 emerges from the opposing end of the first rope passageway 34 at the mid point of the third rope passageway 60 in the cap portion 32 of the end cap 14. The rope 16 extends at an acute angle along one-half of the third rope passageway 60. The rope 16 passes into the cap portion 32 of the end cap 14 through the second rope passageway 58 in the cap portion 32 and through the second rope passageway 25 defined by the second pair of holes 24 in the handle 12. The rope 16 emerges from the second rope passageway 25 and the second rope passageway 58 and extends at an acute angle along the other half of the third rope passageway 60. As can best be seen by referring to FIGS. 9 and 10, one end of the rope 16 is then threaded or braided into itself to form a closed loop 64 and a braided portion 66. A distal portion 68 of the rope 16 extending from the first rope passageway 34 is pulled taut such that the closed loop 64 of the rope 16 is snugly held within the third rope passageway 60 on the cap portion 32 of the end cap 14. The braided portion 66 of the rope 16 is thus positioned within the first rope passageway 34 in the end cap 14. As seen in FIG. 1, a corresponding portion of the rope 16' is likewise threaded through the end cap 14 on the opposing end of the ski tow handle assembly 10 such that the rope 16 and 16' meet at a predetermined distance away from the handle assembly 10 and are joined together by passing one rope 16 into the opposing rope 16' as can be best seen in FIG. 1, or by knotting ropes 16 and 16' (not shown).

The present invention thus provides a water ski tow handle assembly which insures greater safety to the water skier and which provides greater convenience to both the skier and manufacturer. It is to be understood that various modifications can be made to the present invention without departing from the scope of the invention described herein and in the appended claims.

I claim:

1. A water ski tow handle assembly comprising, in combination, a handle having a first end and a second end, each end of the handle having a first handle rope passageway extending transversely through the handle and a second handle rope passageway extending transversely through the handle, the first handle rope passageway being in a spaced apart relationship to the second handle rope passageway and the end of the handle, the second handle rope passageway being in a spaced apart relationship to the first handle rope passageway and adjacent the end of the handle; and, a pair of end caps, each end cap matingly receiving one end of the handle, the end cap having a finger protector sleeve and a cap portion, the end cap defining a first end cap rope passageway extending longitudinally through the finger protector sleeve and the cap portion, the end cap defining a second end cap rope passageway extending transversely through the cap portion, the second end cap rope passageway being in a spaced apart relationship to the first end cap rope passageway, the end cap defining a third end cap rope passageway extending at an acute angle between the first end cap rope passageway and the second end cap rope passageway and connecting the first end cap rope passageway to the second end cap rope passageway;

the end caps being positioned on the handle such that the first handle rope passageway and the first end cap rope passageway are in coaxial alignment and the second handle rope passageway and the second end cap rope passageway are in coaxial alignment.

2. The water ski tow handle assembly according to claim 1, wherein a two rope passes through each first end cap rope passageway and through each first handle rope passageway, the tow rope passes through one-half of each third end cap rope passageway, passes through each second end cap rope passageway and through each second handle rope passageway, the tow rope passes through an opposing half of each third end cap rope passageway, and the tow rope forming a closed loop by being braided into itself and passing back into each first end cap rope passageway.

3. The water ski tow handle assembly according to claim 1, wherein each of the first and second handle rope passageways extend transversely through the handle at an angle perpendicular to the longitudinal axis of the handle.

4. The water ski handle assembly according to claim 3, wherein each first handle rope passageway extends through the handle at a perpendicular angle to each second handle rope passageway.

5. The water ski tow handle assembly according to claim 1, wherein the handle comprises a core bar of a rigid, lightweight material enclosed by a compressible material.

6. A water ski tow handle assembly according to claim 1, wherein each finger protector sleeve extends from each cap portion at an angle perpendicular to the longitudinal axis of the handle.

7. The water ski tow handle assembly according to claim 1, wherein each end cap comprises the finger protector sleeve integrally molded with the cap portion.

8. The water ski tow handle assembly according to claim 1, wherein each cap portion comprises a collar and a plug defining a recess for matingly receiving the end of the handle.

9. The water ski handle assembly according to claim 8, wherein the collar of each cap portion has a substantially cylindrical shape.

10. The water ski handle assembly according to claim 8, wherein the collar of each cap portion has a substantially frustoconical shape.

11. The water ski handle assembly according to claim 8, wherein the plug of each cap portion has a substantially cylindrical shape.

12. The water ski handle assembly according to claim 8, wherein the plug of each cap portion has a substantially frustoconical shape.

13. The water ski tow handle assembly according to claim 1, wherein each second end cap rope passageway extends transversely through each cap portion at an angle perpendicular to the longitudinal axis of the handle.

14. The water ski tow handle assembly according to claim 1, wherein each third end cap rope passageway extends along the exterior of each cap portion.

15. The water ski tow handle assembly according to claim 14, wherein each end cap includes a flange extending over a portion of each third end cap rope passageway.

16. The water ski handle assembly according to claim 5, wherein the compressible material terminates at a point spaced apart from each end of the handle.

17. The water ski handle assembly according to claim 5, wherein the compressible material terminates at a point adjacent each end of the handle.

* * * * *